US011291290B2

(12) United States Patent
DiPierro

(10) Patent No.: US 11,291,290 B2
(45) Date of Patent: Apr. 5, 2022

(54) CLOTHING INTEGRATED TAB SYSTEM

(71) Applicant: Dominic DiPierro, Virginia Beach, VA (US)

(72) Inventor: Dominic DiPierro, Virginia Beach, VA (US)

(73) Assignee: Dynamis Alliance, Corp., Virginia Beach, VA (US)

( * ) Notice: Subject to any disclaimer, the term of this patent is extended or adjusted under 35 U.S.C. 154(b) by 0 days.

(21) Appl. No.: 17/069,271

(22) Filed: Oct. 13, 2020

(65) Prior Publication Data

US 2021/0022486 A1 Jan. 28, 2021

Related U.S. Application Data

(63) Continuation of application No. 16/253,782, filed on Jan. 22, 2019, now Pat. No. 10,842,250.

(60) Provisional application No. 62/621,523, filed on Jan. 24, 2018, provisional application No. 62/620,333, filed on Jan. 22, 2018.

(51) Int. Cl.
*A45F 5/02* (2006.01)
*A41D 1/06* (2006.01)

(52) U.S. Cl.
CPC ..... *A45F 5/02* (2013.01); *A41D 1/06* (2013.01); *A45F 5/021* (2013.01); *A45F 5/022* (2013.01); *A41D 2300/20* (2013.01); *A41D 2400/48* (2013.01); *A45F 2200/0591* (2013.01)

(58) Field of Classification Search
CPC .. A41D 1/06; A41D 2300/20; A41D 2400/48; A45F 2200/0591; A45F 5/02; A45F 5/021; A45F 5/022
See application file for complete search history.

(56) References Cited

U.S. PATENT DOCUMENTS 2,578,237 A * 12/1951 Geistweit ..... A01K 77/00 224/270
3,599,847 A * 8/1971 Danielson ..... B25H 3/006 224/673
4,757,927 A * 7/1988 Rutty ..... A45F 5/02 224/269
4,790,461 A * 12/1988 Stover ..... A45F 5/00 224/234
5,052,603 A * 10/1991 Spina ..... B25H 3/00 224/270
5,582,338 A * 12/1996 Tamura ..... A45F 5/02 224/678
5,673,830 A * 10/1997 Matthews ..... A45F 5/02 224/268
6,257,469 B1 * 7/2001 Cohn ..... A45F 5/004 206/86

(Continued)

*Primary Examiner* — David M Upchurch
(74) *Attorney, Agent, or Firm* — Eversheds Sutherland (US) LLP

(57) ABSTRACT

A clothing integrated tab system is disclosed. The clothing integrated tab system may include an anchor panel. The anchor panel may include a first aperture, a second aperture, a channel extending between the first aperture and the second aperture, and a bridge tab. The bridge tab may be disposed between the first aperture and the second aperture as well as extending over the channel. The clothing integrated tab system may include a tab member removably coupled to the anchor panel and extending through the first aperture, the channel and the second aperture.

9 Claims, 11 Drawing Sheets

(56) References Cited

U.S. PATENT DOCUMENTS

| | | | | |
|---|---|---|---|---|
| D452,610 | S * | 1/2002 | Schwartzmiller | D3/228 |
| 7,077,303 | B2 * | 7/2006 | Zega | A45F 5/00 224/242 |
| D565,396 | S * | 4/2008 | Wipf | D8/367 |
| 10,022,855 | B2 * | 7/2018 | Hintze | B25H 3/04 |
| 10,143,294 | B1 * | 12/2018 | Matson | A45F 3/14 |
| 10,299,576 | B2 * | 5/2019 | Rose | A63C 11/021 |
| 2006/0091174 | A1 * | 5/2006 | Mooney | A63B 57/203 224/670 |
| 2007/0178761 | A1 * | 8/2007 | Wemmer | A45F 5/02 439/596 |
| 2012/0168473 | A1 * | 7/2012 | Arajakis | A45F 5/02 224/250 |
| 2015/0007379 | A1 * | 1/2015 | Cockram | A41D 13/0015 2/236 |
| 2018/0110266 | A1 * | 4/2018 | Lee | A45F 5/02 |
| 2018/0172398 | A1 * | 6/2018 | Ray | F41C 23/02 |
| 2019/0298028 | A1 * | 10/2019 | Haack | A45C 13/38 |

* cited by examiner

CLOTHING INTEGRATED TAB SYSTEM

RELATED APPLICATIONS

This application claims priority to and the benefit of U.S. patent application Ser. No. 16/253,782, filed Jan. 22, 2019, and titled "Clothing Integrated Tab System," which claims priority to U.S. Provisional Patent Application No. 62/620,333, filed Jan. 22, 2018, and titled "Clothing Integrated Tab System," and to U.S. Provisional Patent Application No. 62/621,523, filed Jan. 24, 2018, and titled "Clothing Integrated Tab System," the entire contents of each of which are hereby incorporated by reference herein in their entirety for all purposes.

TECHNICAL FIELD

Embodiments disclosed herein are generally related to clothing and more particularly to apparatuses and methods for a clothing integrated tab system for attaching a device onto a garment.

BACKGROUND

Carrying tools and other equipment or objects typically involves strapping on a utility belt, carrying a bag, or stuffing a clothing pocket with the tools or objects necessary for a particular task. The methods for transporting the equipment can cause an awkward weight distribution and be conspicuous. For example, a wallet may create a bulge in a pants pocket. Similarly, a large pocket knife can also create a bulge in a pants pocket and can be easily distinguishable from other items. Consequently, as a user moves (e.g., walks, runs, bends, etc.), the wallet or other item may not move in conjunction with the movement of the user and/or can offset the user's balance. Further, other equipment such as a firearm magazine can create difficulty in balancing the magazine within a carrying case or pocket of a gunman.

BRIEF DESCRIPTION OF THE SEVERAL VIEWS OF THE DRAWINGS

For a more complete understanding of the present disclosure and certain features thereof, reference is now made to the following description, in conjunction with the accompanying figures briefly described as follows.

DETAILED DESCRIPTION OF THE EXEMPLARY EMBODIMENTS

Example embodiments of the disclosure will now will be described more fully hereinafter with reference to the accompanying drawings, in which exemplary embodiments are shown. The concepts discussed herein may, however, be embodied in many different forms and should not be construed as limited to the example embodiments set forth herein; rather, these embodiments are provided so that this disclosure will be thorough and complete, and will fully convey the scope to those of ordinary skill in the art. Like numbers refer to like, but not necessarily the same or identical, elements throughout.

Certain dimensions and features of the clothing integrated tab system are described herein using the term "approximately." As used herein, the term "approximately" indicates that each of the described dimensions is not a strict boundary or parameter and does not exclude functionally similar variations therefrom. Unless context or the description indicates otherwise, the use of the term "approximately" in connection with a numerical parameter indicates that the numerical parameter includes variations that, using mathematical and industrial principles accepted in the art (e.g., rounding, measurement or other systematic errors, manufacturing tolerances, etc.), would not vary the least significant digit.

In addition, certain relationships between dimensions of the clothing integrated tab system described herein and between features of the clothing integrated tab system are described herein using the term "substantially." As used herein, the terms "substantially" and "substantially equal" indicates that the equal relationship is not a strict relationship and does not exclude functionally similar variations therefrom. Unless context or the description indicates otherwise, the use of the term "substantially" or "substantially equal" in connection with two or more described dimensions or positions indicates that the equal relationship between the dimensions or positions includes variations that, using mathematical and industrial principles accepted in the art (e.g., rounding, measurement or other systematic errors, manufacturing tolerances, etc.), would not vary the least significant digit of the dimensions. As used herein, the term "substantially constant" indicates that the constant relationship is not a strict relationship and does not exclude functionally similar variations therefrom. As used herein, the term "substantially parallel" indicates that the parallel relationship is not a strict relationship and does not exclude functionally similar variations therefrom.

Figure 1:
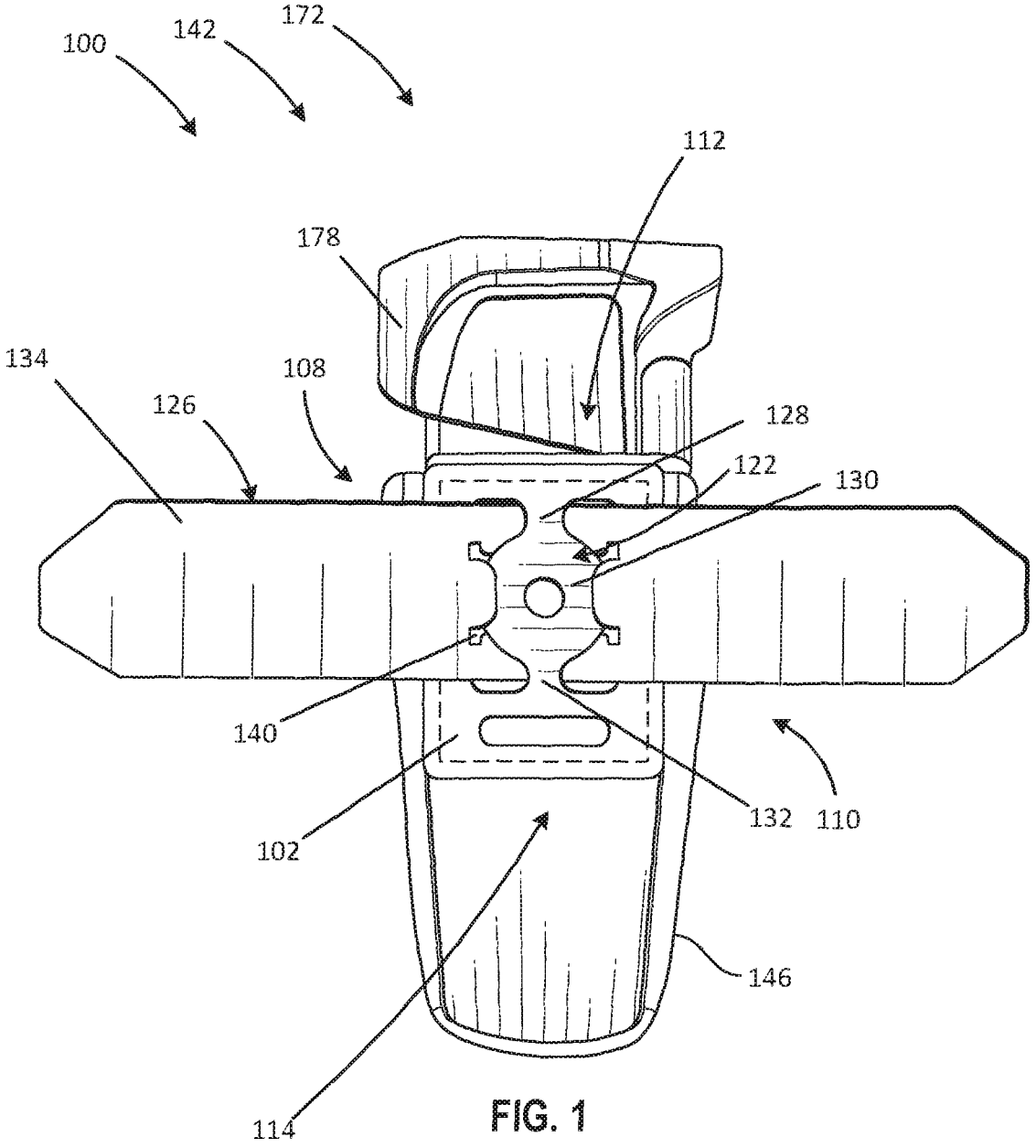
FIG. 1 illustrates a front elevation view of a clothing integrated tab system secured on a container in accordance with one example embodiment of the disclosure.
Figure 2:
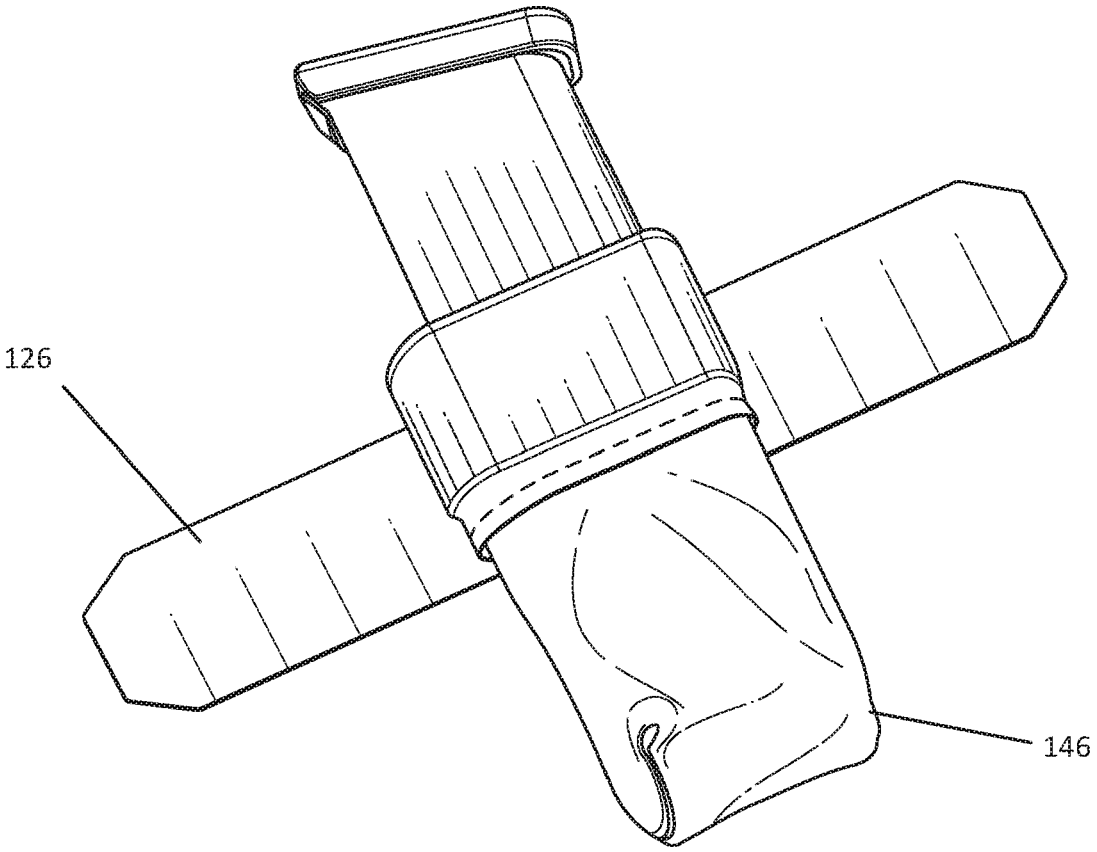
FIG. 2 illustrates a rear perspective view of the clothing integrated tab system of FIG. 1 in accordance with one example embodiment of the disclosure.
Figure 3:
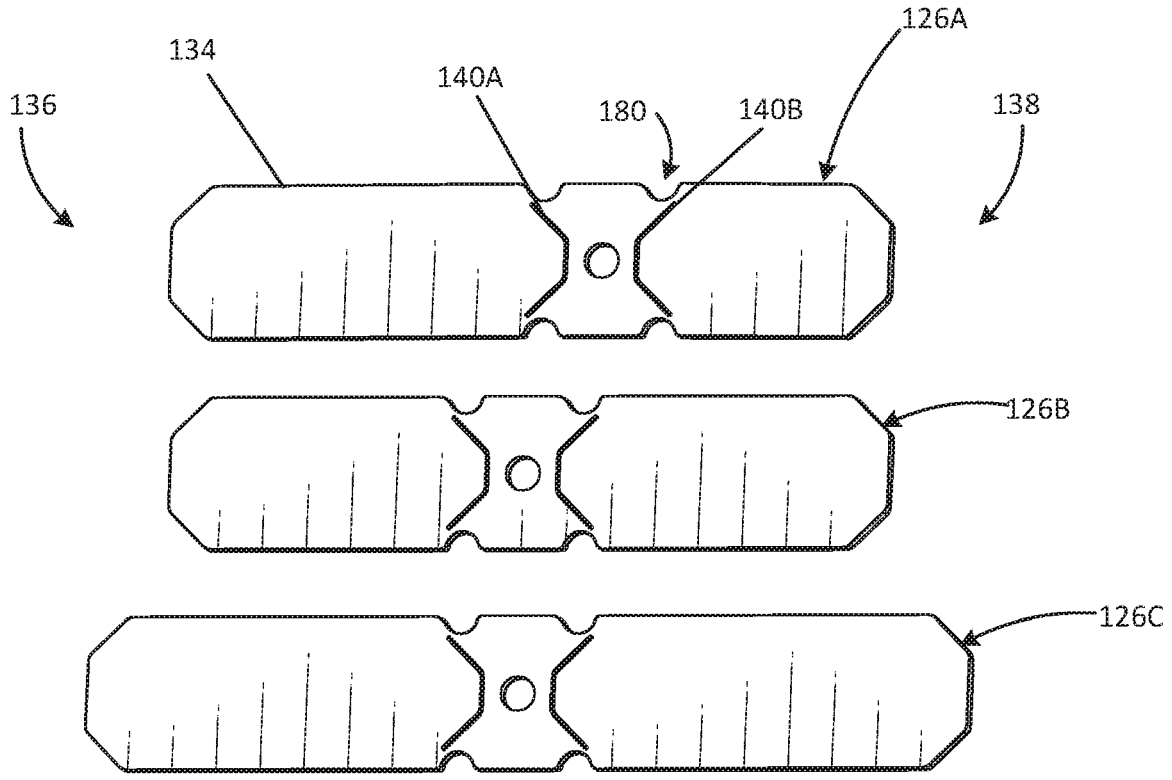
FIG. 3 illustrates a front elevation view of a set of tabs of the clothing integrated tab system of FIG. 1 in accordance with one example embodiment of the disclosure.
Figure 4A:
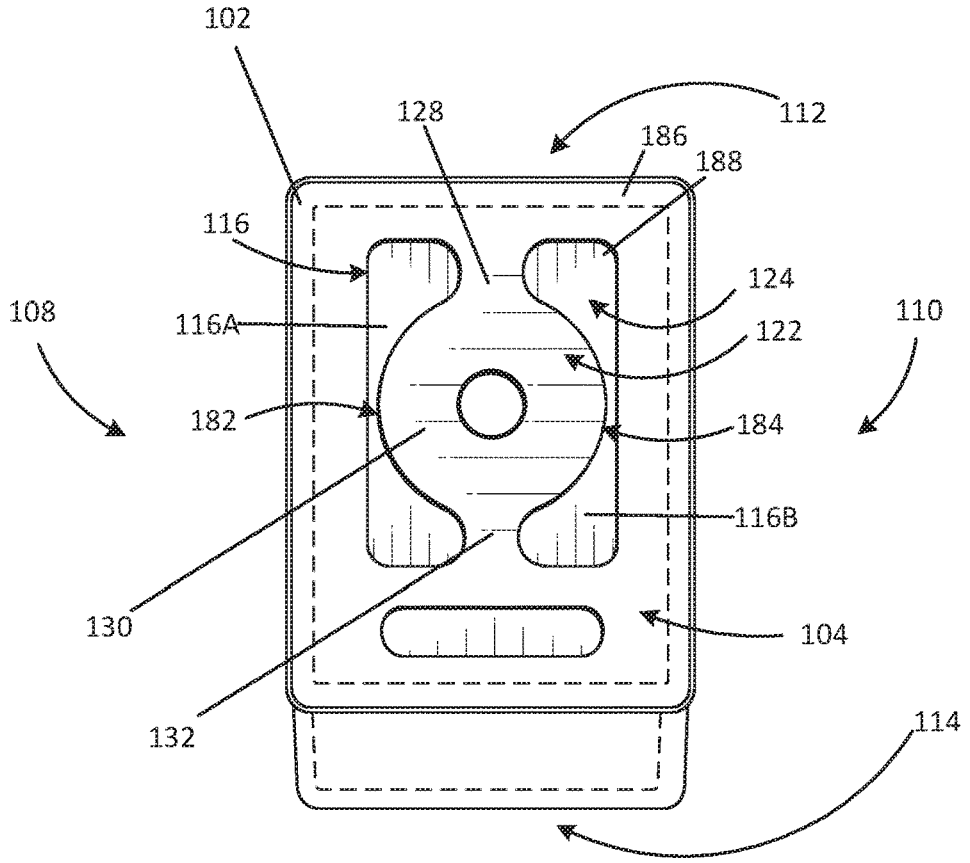
FIG. 4A illustrates a front elevation view of an anchor of the clothing integrated tab system of FIG. 1 in accordance with one example embodiment of the disclosure.
Figure 4B:
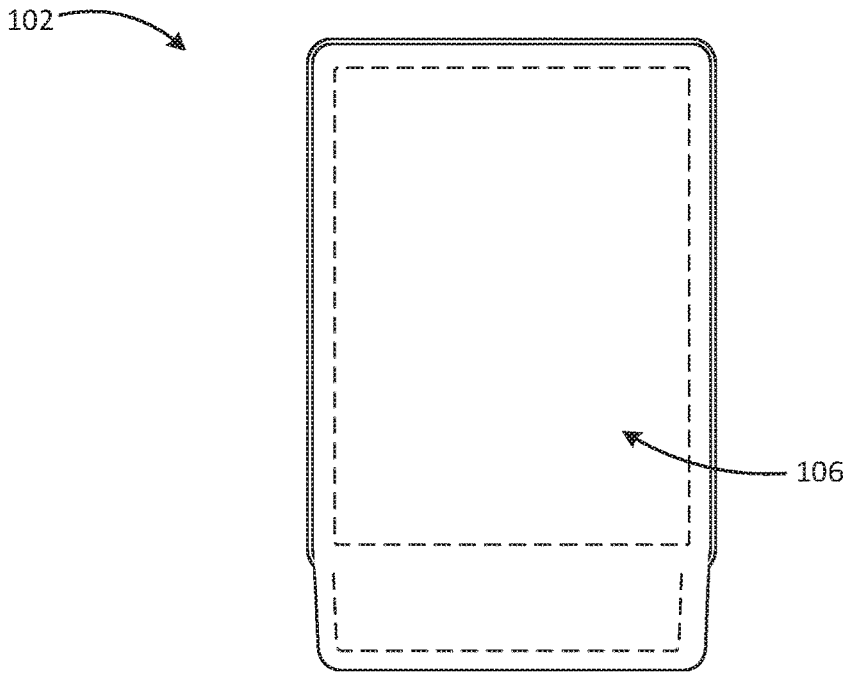
FIG. 4B illustrates a rear elevation view of the anchor of FIG. 4A in accordance with one example embodiment of the disclosure.

FIG. 1 presents a front elevation view of a clothing integrated tab system 100 secured on a container 146 in accordance with one example embodiment of the disclosure. FIG. 2 presents a rear perspective view of the clothing integrated tab system of FIG. 1 secured onto the container 146. FIG. 3 presents a front perspective view of a set of tabs 126 of the clothing integrated tab system 100 removed from an anchor panel 102 of FIG. 1. FIG. 4A presents a front elevation view of the anchor panel 102 of the clothing integrated tab system 100 of FIG. 1 in accordance with one example embodiment of the disclosure. FIG. 4B presents a rear elevation view of the anchor in accordance with one example embodiment of the disclosure. Now referring to FIGS. 1-4B, the example clothing integrated tab system 100 can include an anchor panel 102 and at least one tab member 126 removably coupled to the anchor panel 102. The clothing integrated tab system 100 can also include a container 146 that is coupled to the anchor panel 102. The clothing integrated tab system 100 can include a garment (see 158, FIG. 6) (e.g., pants, shirt, shorts, jacket, underwear, etc.) with multiple slits 160 configured to receive the at least one tab member 126 therein.

The anchor panel 102 can include a front face 104 and an opposing back face 106 a top side 112, an opposing bottom side 114, a first lateral side 108 and an opposing second lateral side 108. In certain examples, each of the front face 104 and the back face 106 can have planar or substantially planar, outward-facing surfaces. In one example embodiment, the front face 104 of the anchor panel 102 can include one or more apertures 116 that extend into the front face 104 and are fluidically coupled to one-another to define a channel 124 through at least a portion of the front face 104. In certain examples, the front face 104 can include a first aperture 116A and a second aperture 116B that are fluidically coupled to one another via the channel 124.

The front face 104 can include a top surface 186 and a recessed surface 188. The recessed surface 188 can be defined by a recessed volume in the front face. In certain examples, the top surface 186 and the recessed surface 188 can have planar or substantially planar, outward-facing surfaces.

The anchor panel 102 can also include a bridge tab 122 that extends across the channel 124. In one example, the bridge tab 122 can extend from a bottom edge of the channel 124 to a top edge of the channel 124 and can be configured to receive the tab member between the back side of the bridge tab 122 and the channel 124. In other examples, the bridge tab 122 can be constructed to extend over other portions of the channel 124. In one example embodiment, the bridge tab 122 is configured to removably couple the at least one tab member 126 to the anchor panel 102. The bridge tab 122 can include a first connecting arm 128, a bridge tab member 130, and a second connecting member 132. The first connecting arm 128, the bridge tab member 130, and the second connecting arm 132 can be disposed between the first aperture 116A and the second aperture 116B. The first connecting arm 128 and the second connecting arm 130 can be coupled to and/or integrally formed with the bridge tab member 130. In certain examples, the first connecting arm 128 can have a first end coupled and/or integrally formed with the bridge tab member 130 and a distal second end coupled to the front face 104 of the anchor panel 102. In certain examples, the second connecting arm 132 can have a first end coupled and/or integrally formed with the bridge tab member 130 and a distal second end coupled to the front face 104 of the anchor panel 102. In one example, the first connecting arm 128 can extend from a first end of the bridge tab member 130 and the second connecting arm 128 can extend from a second end of the bridge tab member opposite the first end. For example, the first connecting arm 128 can extend from a top end and the second connecting arm 132 can extend from an opposing bottom end of the bridge tab member 130.

In one example, anchor panel 102 can be constructed of a rear panel and a front panel. Each of the rear panel and the front panel can have substantially flat or planar front and back surfaces. The rear panel can be solid or substantially solid and free of apertures. The front panel can include the first aperture 116A, bridge tab 122, and the second aperture 116B. The back surface of the front panel can be positioned on top of the front surface of the rear panel and the front panel can be fixedly coupled to the rear panel, with the space between the back surface of the bridge tab 122 and the front surface of the rear panel defining the channel 124 between the first aperture 116A and the second aperture 116B. In one example, the front panel can be sewn to the rear panel. In other examples, the front panel can be coupled to the rear panel using one or more coupling devices, such as pins, rivets, eyelets, adhesive, heat welding, or similar coupling devices or methods. In certain examples, each of the first aperture 116A and the second aperture 116B are aligned along a horizontal axis of the anchor panel 102 and can have substantially the same size and shape. The channel 124 can receive at least one tab member 126. The series of apertures 116 can be disposed adjacent to a first side 108 and a second side 110. The series of apertures 116 can include a first aperture 116A and a second aperture 116B. The series of apertures 116 can extend between the top side 112 and the bottom side 114. In other embodiments, the series of apertures 116 can include more than two apertures and be disposed on the anchor panel 102 in a plurality of other orientations.

In certain examples, the bridge tab member 130 can have a circular shape. In other examples, the bridge tab member 130 can have any other shape including, but not limited to, rectangular, square, triangular, or some other shape. In certain embodiments, the first connecting arm 128 and the second connecting arm 132 are narrower than the bridge tab member 130 at its widest point. All or a portion of the bridge tab member 130 may engage the at least one tab member 126. For example, a first portion 182 of the bridge tab member 130 can engage an incision 140A,140B of the tab member 126 and a second portion 184 of the bridge tab member 130 different from the first portion 182 can engage another incision 140A,140B of the tab member 126 different from the first feature. In this example, the first portion 182 of the bridge tab member 130 can be a first side portion and the second portion 184 can be an opposing second side portion. The anchor panel 102 can be made of any material including, but not limited to, plastic, vinyl, rubber, cloth, metal, alloy, composites, or any combination thereof. In one example, all or at least a portion of the anchor panel 102 is formed of a thermoplastic (e.g., tegris, hypalon, etc.).

The clothing integrated tab system 100 can also include at least one tab member 126. In one example, the tab member 126 is an elongated member having a length that is substantially greater than its width and thickness. The at least one tab member can have an elongated body 134 having a proximate end 136 and a distal end 138, the distance between which defines the length of the tab member 126.

In one example, the tab member 126 can include at least two incisions 140 through the elongated body 134. As used herein, the terms "incision" and "slot" may be interchangeable. Each of the incisions or slots 140 can be configured to engage the bridge tab member 130. For example, a first portion 182 of the bridge tab member 130 may be insertable into a first one of the incisions or slots 140 and a second portion 184 of the bridge tab member 130 may be insertable into a second one of the incisions or slots 140 to couple the tab member 126 to the anchor panel 102. Each incision or slot 140 may define an aperture in the tab member 126 that extends from a front side of the tab member 126 to the back side of the tab member 126. In certain example embodiments, the incisions or slots 140 may be positioned generally in the center of the tab member 126 along its length, as shown for tab members 126B and 126C in FIG. 3. In other examples, the incisions or slots 140 may be offset from the center of the tab member 126A along its length between the proximate end 136 and the distal end 138.

The at least one tab member 126 may adjusted between an engaged configuration 142, in which the at least one tab member 126 is removably coupled to the anchor panel 102 and a disengaged configuration 144, in which the at least one tab member 126 is decoupled from the anchor panel 102, via the incisions 140 and the bridge tab member 130. In one example embodiment, the at least one tab member 126 may be slidably inserted by a user into one of the first aperture 116A and the second aperture 116B, through the channel 124 under the bridge tab 122, and through the other of the first aperture 116A and second aperture 116B. A first portion 182 of the bridge tab member 130 can be inserted into the first incision or slot 140A and a second portion 184 of the bridge tab member 130 can be inserted into the second incision or slot 140B to couple the tab member 126 to the bridge tab member 130 and to the anchor panel 102. In the engaged configuration 142, a portion of the tab member 126 adjacent each of the incisions or slots 140 can be configured to overlay opposing portions of the bridge tab member 130. In one example, the at least one tab member 126 may be slidably displaced from between the bridge tab 122 and the remainder of the front face 104 of the anchor panel 102 and into a disengaged configuration 144, where the tab member 126 is not coupled to and is removed from the anchor panel 102.

The tab member 126 can also include one or more indentations 180 extending into a top and/or bottom side of the tab member. In one example, the indentations 180 may be positioned adjacent to one or more of the incisions or slots 140. For example, an indentation 180 may be provided adjacent each of the incisions or slots 140 in the tab member 126 along each of the bottom and top sides of the tab member 126. In this example, four indentations 180 are provided on the tab member, however, greater or fewer than four indentations 180 and the number of indentations 180 provided along the top side and bottom side of the tab member 126 may be the same or different. In one example, each indentation 180 may be a concave recess along the top and/or bottom side edge of the tab member 126. In certain examples, the incisions or slots 140 may be disposed adjacent to the one or more dimples 180.

Figure 5A:
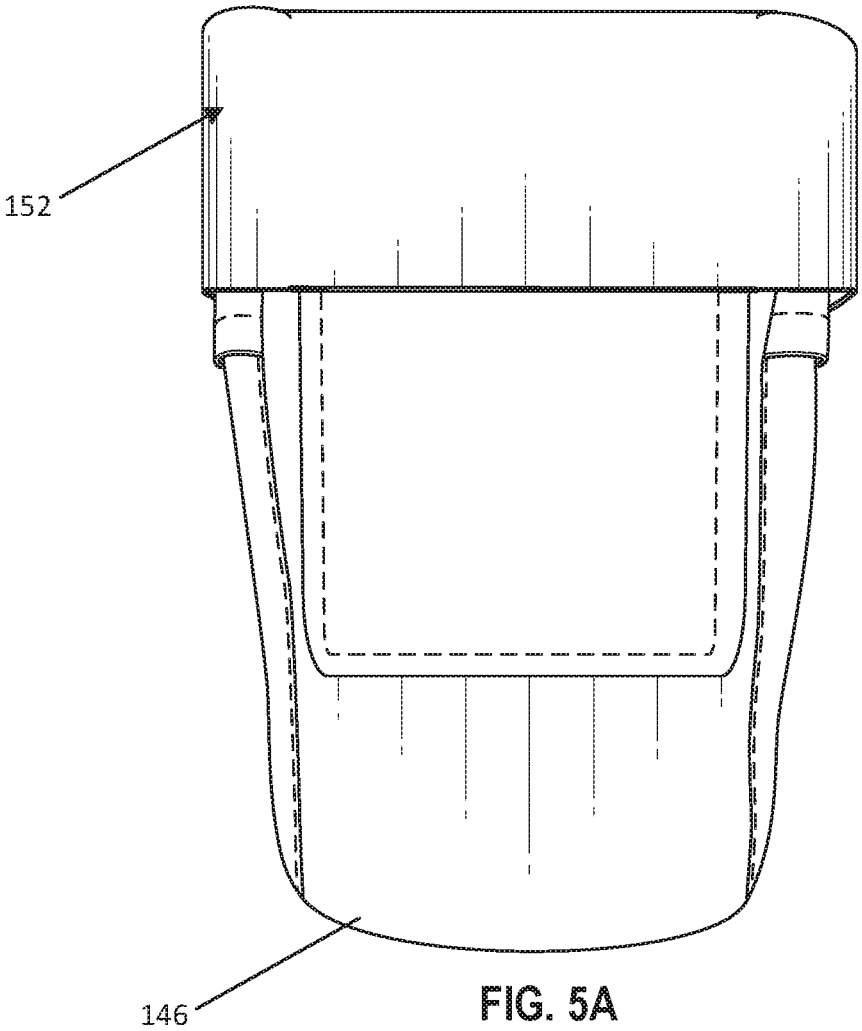
FIG. 5A illustrates a rear elevation view of a container for the integrated tab system of FIG. 1 in accordance with one example embodiment of the disclosure.
Figure 5B:
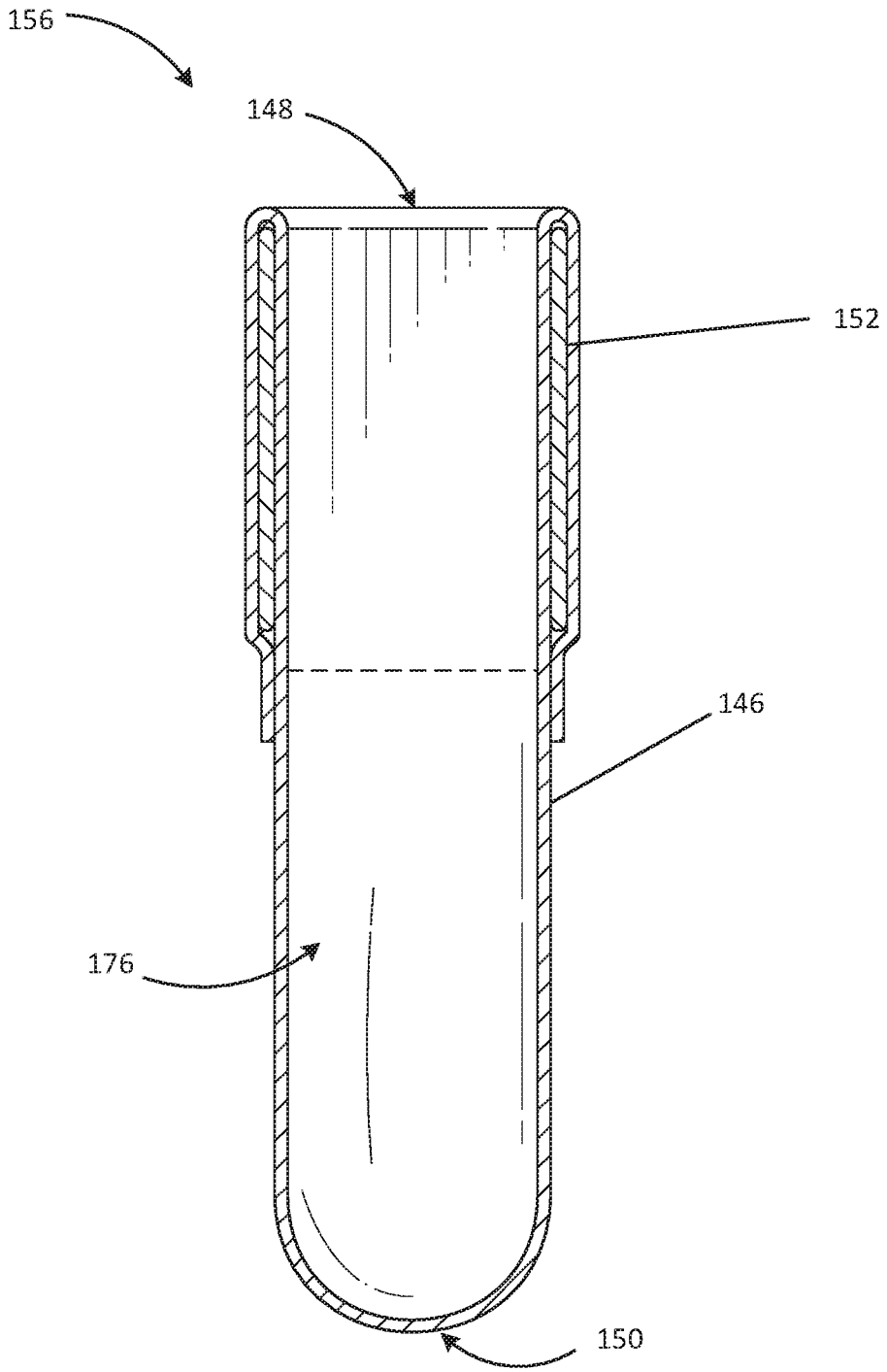
FIG. 5B illustrates a cross-sectional view of the container of FIG. 5A in accordance with one example embodiment of the disclosure.
Figure 6:
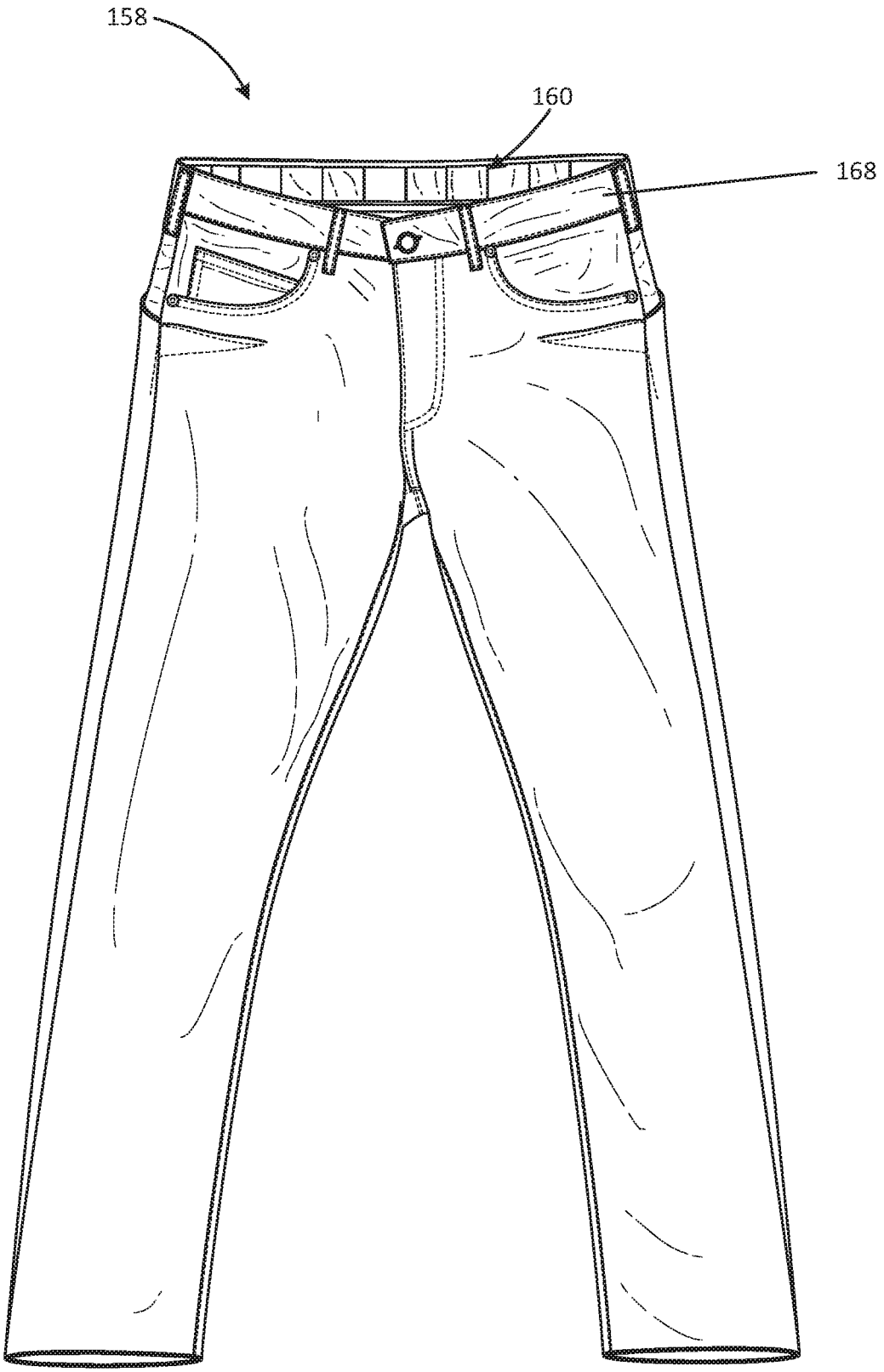
FIG. 6 illustrates a perspective view of a garment for use with the clothing integrated tab system of FIG. 1 in accordance with one example embodiment of the disclosure.
Figure 7A:
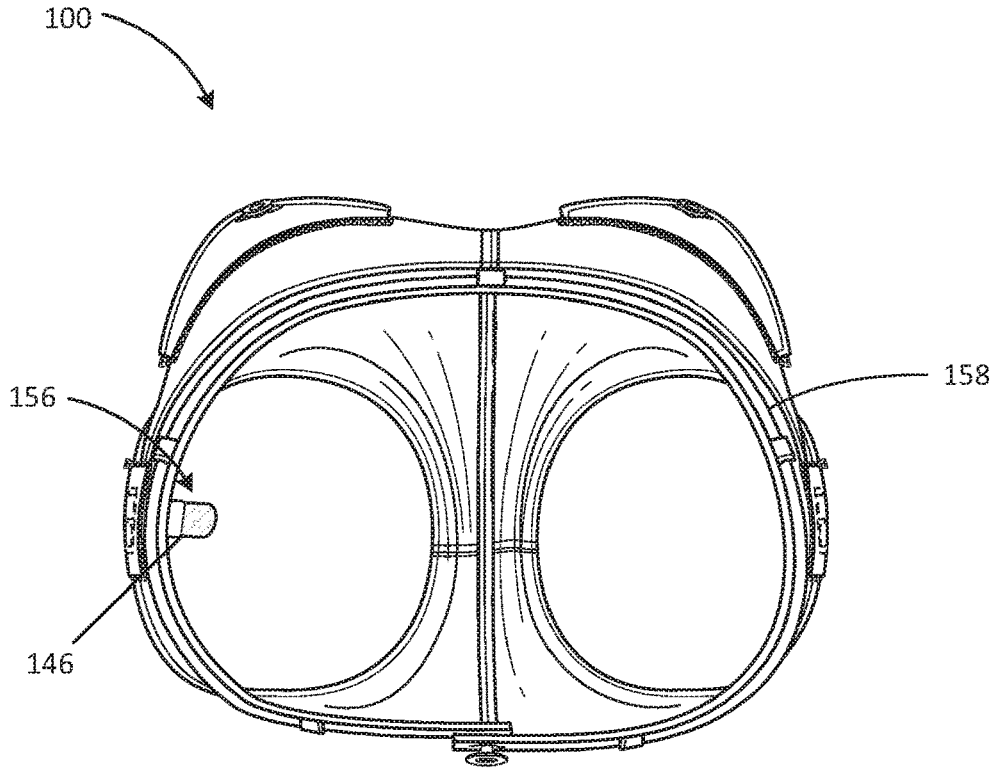
FIG. 7A illustrates a top view of the clothing integrated tab system of FIG. 1 in an open configuration disposed within the garment of FIG. 6 in accordance with one example embodiment of the disclosure.
Figure 7B:
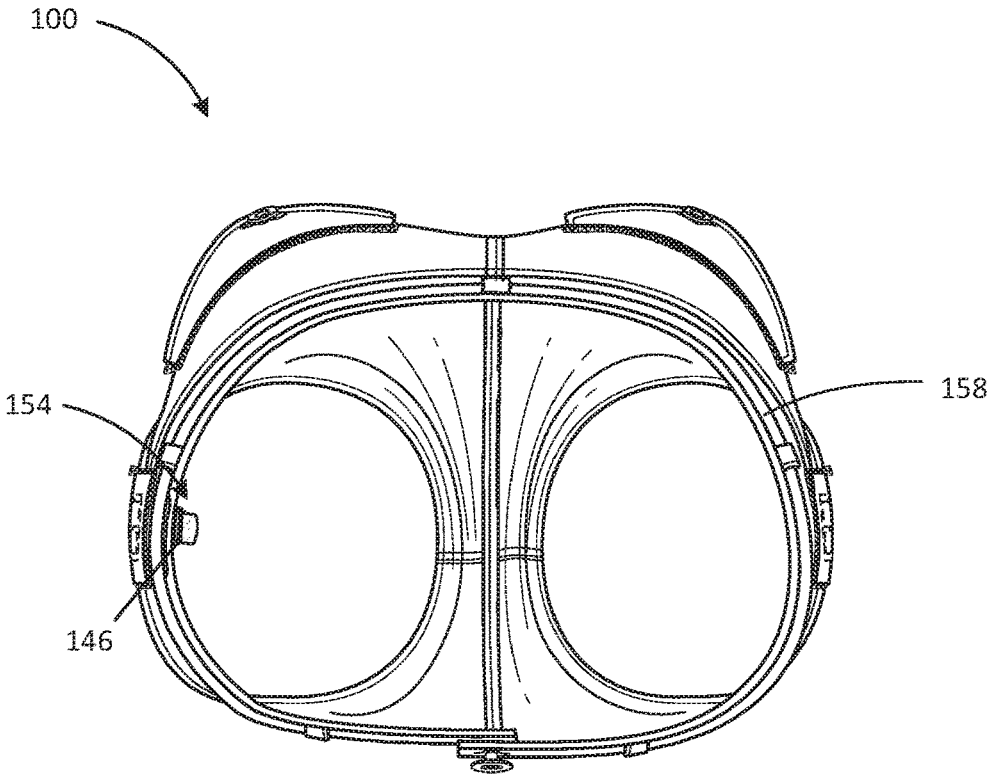
FIG. 7B illustrates a top view of the clothing integrated tab system of FIG. 1 in a collapsed configuration disposed within the garment of FIG. 6 in accordance with one example embodiment of the disclosure.
Figure 8:
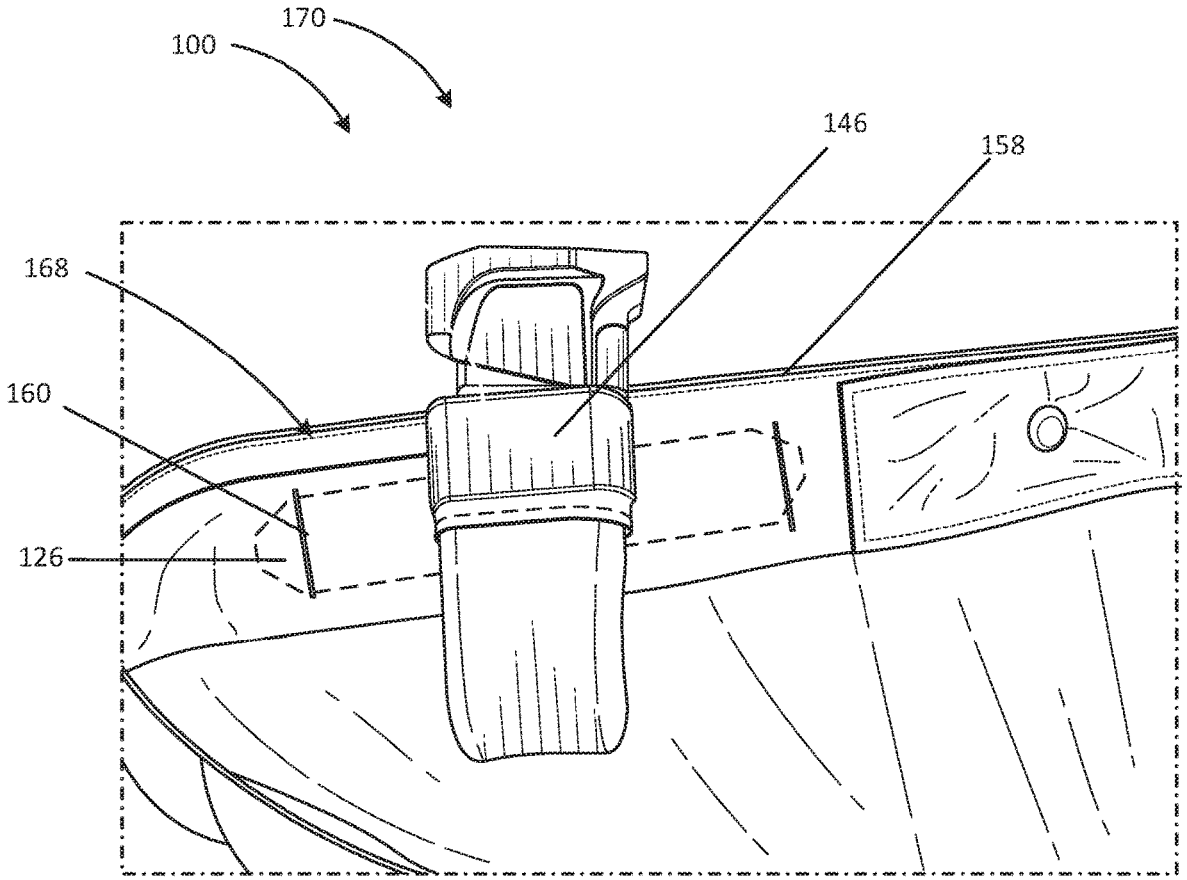
FIG. 8 illustrates a perspective view of the clothing integrated tab system of FIG. 1 coupled to the garment of FIG. 6 in accordance with one example embodiment of the disclosure.
Figure 9:
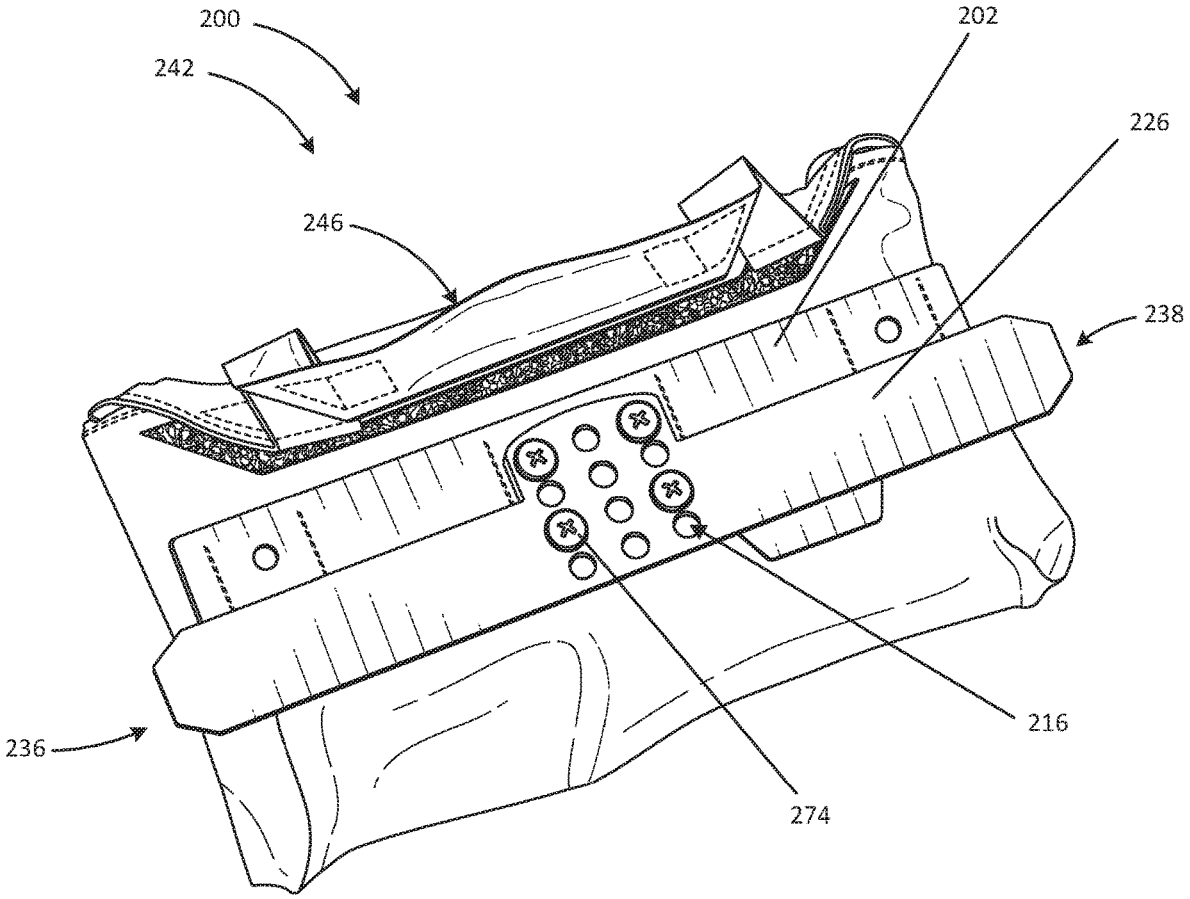
FIG. 9 illustrates a perspective view of a clothing integrated tab system secured on a first aid kit in accordance with one example embodiment of the disclosure.
Figure 10:
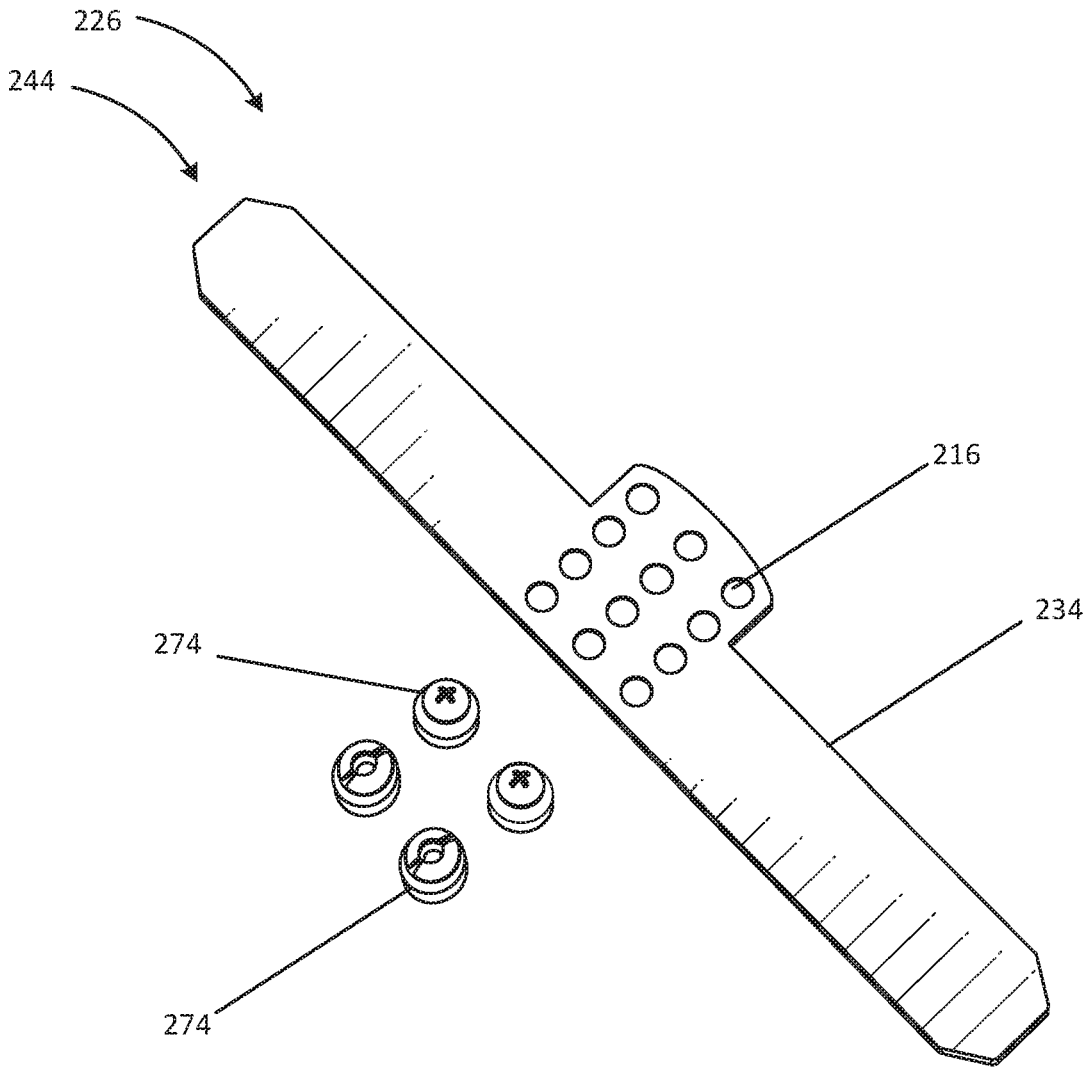
FIG. 10 illustrates a perspective view of a tab of the clothing integrated tab system of FIG. 9 in accordance with one example embodiment of the disclosure.

FIG. 5A presents a rear view of a container 146 for the clothing integrated tab system 100 in accordance with one example embodiment of the disclosure. FIG. 5B presents a cross-sectional view of the container of FIG. 5A in accordance with one example embodiment of the disclosure. FIG. 6 presents a perspective view of a garment 158 for the clothing integrated tab system 100 in accordance with one example embodiment of the disclosure. FIGS. 7A-B present a top view of the clothing integrated tab system 100 disposed in the garments 158 of FIG. 6 in accordance with one example embodiment of the disclosure. FIG. 8 presents the clothing integrated tab system 100 disposed within a waistband 168 of the garment 158 in accordance with one example embodiments of the disclosure. FIG. 9 presents a clothing integrated tab system 200 secured on a garment 258 in accordance with one example embodiment of the disclosure. FIG. 10 presents a tab 226 of the clothing integrated tab system 200 of FIG. 9 in accordance with one example embodiment. Referring now to FIGS. 1-10, the clothing integrated tab system 100 can also include a container 146. In one example, the container 146 can be constructed of cloth, thermoplastic, metal, alloy vinyl, rubber, or some combination thereof. The container 146 can include a receiving end 148 with a mouth defined at least partially by a rim and a closed end 150. For example, the container 146 can include cloth extending from the receiving end 148 to the closed end 150.

In certain examples, the receiving end 148 can include a collapsible member 152 disposed along the rim or mouth of the container 146. In one example, the collapsible member can be elastic and configured to adjust the mouth of the receiving end 148 from a receiving configuration 156, where the mouth is open, to a collapsed or closed configuration 154, where the mouth is closed or substantially closed and insertion of a device(s) into the container 146 is substantially prevented. In certain examples, the collapsible member is an elastic band, collapsible ring, drawstring or other similar device. At the mouth of the receiving end 148, the collapsible member 152 may open or otherwise provide access to an inner volume 176 of the container 146 in the receiving configuration 156. Conversely, the collapsible member 152 may be sufficiently flexible and/or elastic that access to the inner volume 176 is closed when applying a force to the collapsible member 152.

The container 146 can be fixedly or removably coupled to the anchor panel 102. For example, the back face 106 of the anchor panel 102 can be placed to abut the container 146 for coupling the anchor panel 102 to the container 146. In certain examples, the container 146 can be sewn onto the anchor panel 102 or the anchor panel 102 can be sewn onto the container 146. In other examples, the anchor panel 102 may be fixedly coupled to the container 146 using other coupling devices and methods, including, but not limited to, adhesives, heat welding, rivets, eyelets, pins, snaps, and/or Velcro.

The clothing integrated tab system 100 can also include a garment 158. The garment 158 can be any article of clothing worn or carried by a person including, but not limited to, pants, a shirt, a jacket, shorts, underwear, a vest, a belt, or the like. The garment 158 can include two or more slits 160 disposed within the garment. For example, if the garment 158 is shorts or a pair of pants, the slits 160 can be disposed in or adjacent a waistline 168 area of the garment. The slits 160 can be openings or apertures in the garment 158 that are configured to receive a portion of the at least one tab member 126. For example, the anchor panel 102 and the at least one tab member 126 may be secured together in the engaged configuration 142. On the garment 158, a first slit can receive slidably receive therein a proximate end 136 of the tab member 126 and a second, adjacent slit can slidably receive therein a distal end 138 of the tab member 126. The bridge tab 122 of the anchor panel 102 may then abut the material of the garment 158 between the slits 160. In certain examples, the clothing integrated tab system 100 includes a secured configuration 170, in which the anchor panel 102 and container 146 are removably coupled to the garment 158 and an unsecured position 172, in which the anchor panel 102 and container 146 are decoupled from the garment 158. In the secured configuration 170, the tab member 126 can be in the engaged configuration 142 with respect to the anchor panel 102 and the tab member 126 is then inserted into two of the slits 160 in the garment. In the unsecured configuration 172, the tab member 126 can be detached from the garment 158 and the slits 160 disposed therein.

In the secured configuration 170, the container 146 and the anchor panel 102 can be positioned adjacent to the garment 158. For example, the bridge tab 122 on the anchor panel 102 can abut the material (e.g., the material on the waistline 168) of the garment. In certain examples, the container 146 can be in the secured configuration 170 and mouth of the container 146 can be in the collapsed position 154. The inner volume 176 of the container and the resilient member 152 can substantially flatten against the garment interior 164. In certain examples, the container 146 can be in the secured configuration 170 and the mouth of the container 146 can be in the open/receiving position 156. For example, the container 146 can contain a firearm magazine 178 or any other tool or device in the receiving position 156. The collapsible ring 152 and the inner volume 176 may not lie flat in the garment interior 164 when a tool or device is inserted into the container 146. In certain embodiments, the container 146 may be a sheath, wallet, nightstick holder, or other tool holder.

Now referring to FIGS. 9-10, another example for a clothing integrated tab system 200 is shown and described. The alternative clothing integrated tab system 200 can include an anchor 202. The clothing integrated tab system 200 can include at least one tab 226 selectively secured within the anchor 202. The clothing integrated tab system 200 can be secured on a container 246. The clothing integrated tab system 200 can include a garment 258 with a plurality of slits 160 (as shown in FIG. 8) configured to receive the at least one tab 226.

The clothing integrated tab system 200 can also include at least one tab 226 with a series of apertures 216 configured to engage the anchor 202. The apertures 216 may be disposed in the center of the tab 226. In other examples, the apertures 216 may be offset from the center of the tab 226 between the proximate end 236 and the distal end 238. The at least one tab 226 may selectively alter between an engaged configuration 242 and a disengaged configuration 244 via apertures 216 and series of fasteners 274. The anchor 202 can include apertures 216 that align with the apertures 216 on the tab 226.

Various features, aspects, and embodiments have been described herein. The features, aspects, and embodiments are susceptible to combination with one another as well as to variation and modification, as will be understood by those having skill in the art. The present disclosure should, therefore, be considered to encompass such combinations, variations, and modifications.

The terms and expressions which have been employed herein are used as terms of description and not of limitation, and there is no intention, in the use of such terms and expressions, of excluding any equivalents of the features shown and described (or portions thereof), and it is recognized that various modifications are possible within the scope of the claims. Other modifications, variations, and alternatives are also possible. Accordingly, the claims are intended to cover all such equivalents.

Example 1 may include a clothing integrated tab system. The clothing integrated tab system may include an anchor with a front face, an opposed back face, a first side, a second side, a top side, and a bottom side. The anchor may also include a series of apertures disposed on the front face of the anchor and a bridge disposed between the series of apertures. The clothing integrated tab may include at least one tab configured to slide between the series of apertures and secure the at least one tab.

Example 2 may include the clothing integrated tab system of example 1. The bridge may include a first connecting platform extending from the top side and a base platform coupled to the first connecting platform. The base platform may be configured to secure the at least one tab. The bridge may also include a second connecting platform extending between the base platform and the bottom side.

Example 3 may include the clothing integrated tab system of example 2 where the base platform is substantially circular.

Example 4 may include the clothing integrated tab system of example 1. The at least one tab may include an elongated body with a proximate end and a distal end. The at least one tab may also include at least two incisions disposed between the proximate end and the distal end, where at least two incisions are configured to engage the bridge.

Example 5 may include the clothing integrated tab system of example 4. The clothing integrated tab system may include an engaged configuration and a disengaged configuration. The engaged configuration the at least one tab may be secured onto the bridge via the at least two incisions. In the disengaged configuration, the at least one tab separates from the bridge.

Example 6 may include the clothing integrated tab system of example 1 with a container. The container may include a receiving end and a closed end. The container may also include a collapsible ring disposed on the receiving end. The collapsible ring may alter configuration between a collapsed position and a receiving position.

Example 7 may include the clothing integrated tab system of example 1 with a plurality of slits disposed on a garment. The slits may be configured to receive the at least one tab.

Example 8 may include the clothing integrated tab system of example 7 where the garment includes a pair of pants. The pants may include a pant interior and a pant exterior, and the pant interior includes a waistline. The slits may be disposed on the pant interior waistline.

Example 9 may include the clothing integrated tab system of example 7. The tab system may include a secured position and an unsecured position. In the secured position, the at least one tab is set within the at least two slits disposed on the garment. In the unsecured position, the at least one tab is decoupled from the at least two slits.

Example 10 may include a clothing integrated tab system. The clothing integrated tab system may include an anchor with a front face, an opposed back face, a first side, a second side, a top side, and a bottom side. The anchor may include a first aperture and a second aperture disposed on the front face. The anchor may include a bridge disposed between the first aperture and the second aperture. The tab system may include at least one tab configured to slide between the first aperture and the second aperture. The at least one tab may include an elongated body with a proximate end and a distal end. The at least one tab may also include at least two incisions disposed between the proximate end and the distal end, where the at least two incisions may be configured to engage the bridge. The at least two incisions may include an engaged configuration and a disengaged configuration, wherein the engaged configuration the at least one tab is secured onto the bridge via the at least two incisions. In the disengaged configuration, the at least one tab may separate from the bridge.

Example 11 may include the clothing integrated tab system of example 10. The tab system may include a plurality of slits disposed on a garment where the slits are configured to receive the at least one tab.

Example 12 may include the clothing integrated tab system of example 10. The bridge may include a first connecting platform extending from the top side. The bridge may also include a base platform coupled to the first connecting platform where the base platform is configured to secure the at least one tab. The bridge may include a second connecting platform extending between the base platform and the bottom side.

Example 13 may include the clothing integrated tab system of example 11. The clothing integrated tab system may include a secured position and an unsecured position. In the secured position, the at least one tab may be set within the at least two slits disposed on the garment. In the unsecured position, the at least one tab may be decoupled from the at least two slits.

Example 14 may include the clothing integrated system of example 11. The garment may include a pair of pants with a pant interior and a pant exterior, the pair of pants including a waistline. The slits may be disposed on the pant interior waistline.

Example 15 may include a clothing integrated tab system. The tab system may include an anchor with a front face, an opposed back face, a first side, a second side, a top side, and a bottom side. The anchor may include a series of apertures disposed on the front face of the anchor and a bridge disposed between the series of apertures. The tab system may include at least one tab configured to slide between the series of apertures and secure the at least one tab. The tab system may also include a plurality of slits disposed on a garment, where the slits are configured to receive the at least one tab.

Example 16 may include the clothing integrated tab system of example 15. The garment may include a pair of pants with a pant interior and a pant exterior. The pair of pants may include a waistline where the slits are disposed on the pant interior waistline.

Example 17 may include the clothing integrated tab system of example 15. The tab system may include a secured position and an unsecured position. In the secured position, the at least one tab may be set within at least two slits disposed on the garment. In the unsecured position, the at least one tab may be decoupled from the at least two slits.

Example 18 may include the clothing integrated tab system of example 15. The at least one tab may include an elongated body with a proximate end and a distal end. The at least one tab may also include at least two incisions disposed between the proximate end and the distal end, where the at least two incisions are configured to engage the bridge.

Example 19 may include the clothing integrated tab system of example 15. The bridge may include a first connecting platform extending from the top side and a base platform coupled to the first connecting platform. The base platform may be configured to secure the at least one tab and a second connecting platform extending between the base platform and the bottom side.

Example 20 may include the claim integrated tab system of example 19 where the base platform is circular.

Although clothing integrated system features, functions, components, and parts have been described herein in accordance with the teachings of the present disclosure, the scope of coverage of this patent is not limited thereto. On the contrary, this patent covers all embodiments of the teachings of the disclosure that fairly fall within the scope of permissible equivalents.

Conditional language, such as, among others, "can," "could," "might," or "may," unless specifically stated otherwise, or otherwise understood within the context as used, is generally intended to convey that certain implementations could include, while other implementations do not include, certain features, elements, and/or operations. Thus, such conditional language generally is not intended to imply that features, elements, and/or operations are in any way required for one or more implementations or that one or more implementations necessarily include logic for deciding, with or without user input or prompting, whether these features, elements, and/or operations are included or are to be performed in any particular implementation.

Many modifications and other implementations of the disclosure set forth herein will be apparent having the benefit of the teachings presented in the foregoing descriptions and the associated drawings. Therefore, it is to be understood that the disclosure is not to be limited to the specific implementations disclosed and that modifications and other implementations are intended to be included within the scope of the appended claims. Although specific terms are employed herein, they are used in a generic and descriptive sense only and not for purposes of limitation.

The invention claimed is:

1. A clothing integrated tab system, comprising:

an anchor panel comprising:

a first aperture;

a second aperture;

a channel extending from the first aperture to the second aperture; and a bridge tab disposed between the first aperture and the second aperture and extending over the channel, wherein the bridge tab comprises:

a first connecting arm coupled to the anchor panel;

a second connecting arm coupled to the anchor panel; and a bridge tab member coupled to the first connecting arm and the second connecting arm;

a tab member coupled to the anchor panel; and a garment comprising a first slit and a second slit, wherein the tab member is configured to be inserted into the first slit and the second slit.

2. The clothing integrated tab system of claim 1, wherein the bridge tab member is circular.

3. The clothing integrated tab system of claim 1, wherein the tab member is removably coupled to the bridge tab member.

4. The clothing integrated tab system of claim 1, wherein the tab member comprises:

an elongated body comprising a proximate end and a distal end; and at least two slots in the elongated body between the proximate end and the distal end, wherein a first portion of the bridge tab member is inserted into a first slot of the at least two slots and a second portion of the bridge tab member is inserted into a second slot of the at least two slots of the tab member.

5. The clothing integrated tab system of claim 1, further comprising a container coupled to the anchor panel, the container comprising:

a receiving end;

a closed end; and at least one container wall extending from the receiving end to the closed end.

6. The clothing integrated tab system of claim 5, wherein the container further comprises a collapsible member disposed on the receiving end and configured to adjust the receiving end of the container between a closed position and an open position.

7. The clothing integrated tab system of claim 5, wherein the anchor panel comprises a front face and an opposing back face, wherein the container is coupled to a first one of the front face and the back face of the anchor panel and the tab member is removably coupled to a second one of the front face and the back face different from the first one.

8. The clothing integrated tab system of claim 1, wherein the garment comprises:

a pair of pants comprising a pant interior and a pant exterior, wherein the first slit and the second slit are disposed in the pant interior.

9. A clothing integrated tab system comprising:

an anchor panel comprising:

a first aperture;

a second aperture;

a channel extending from the first aperture to the second aperture; and a bridge tab disposed between the first aperture and the second aperture and extending over the channel;

a tab member coupled to the anchor panel, wherein the tab member comprises:

an elongated body comprising a proximate end and a distal end;

a first slot disposed through the elongated body; and a second slot disposed through the elongated body, wherein the bridge tab extends into the first slot and the second slot; and a garment comprising a first slit and a second slit, wherein the tab member is configured to be inserted into the first slit and the second slit.

* * * * *